US012332031B2

(12) United States Patent
Moderegger et al.

(10) Patent No.: US 12,332,031 B2
(45) Date of Patent: Jun. 17, 2025

(54) DECOY TARGET, SYSTEM AND METHOD FOR PROTECTING AN OBJECT

(71) Applicant: RHEINMETALL WAFFE MUNITION GMBH, Suedheide (DE)

(72) Inventors: Tobias Moderegger, Bischofswiesen (DE); Martin Fegg, Bischofswiesen (DE)

(73) Assignee: Rheinmetall Waffe Munition GmbH, Suedheide (DE)

( * ) Notice: Subject to any disclaimer, the term of this patent is extended or adjusted under 35 U.S.C. 154(b) by 381 days.

(21) Appl. No.: 17/566,087

(22) Filed: Dec. 30, 2021

(65) Prior Publication Data

US 2022/0290951 A1 Sep. 15, 2022

Related U.S. Application Data

(63) Continuation of application No. PCT/EP2020/064151, filed on May 20, 2020.

(30) Foreign Application Priority Data

Jul. 2, 2019 (DE) ..... 10 2019 117 801.0

(51) Int. Cl.

| | |
|---|---|
| ***F41J 9/08*** | (2006.01) |
| ***F41H 11/02*** | (2006.01) |
| ***F41J 2/00*** | (2006.01) |

(52) U.S. Cl.

CPC ..... *F41J 9/08* (2013.01); *F41H 11/02* (2013.01); *F41J 2/00* (2013.01)

(58) Field of Classification Search

CPC ..... F41J 9/08; F41J 2/00; F41H 11/02

USPC ..... 342/9

See application file for complete search history.

(56) References Cited

U.S. PATENT DOCUMENTS

| | | | |
|---|---|---|---|
| 3,010,103 | A | 11/1961 | Hopper et al. |
| 3,296,617 | A | 1/1967 | Rogallo |
| 4,072,948 | A | 2/1978 | Drews et al. |
| 4,695,841 | A | 9/1987 | Billard |

(Continued)

FOREIGN PATENT DOCUMENTS

| | | |
|---|---|---|
| AT | 37463 | 10/1988 |
| DE | 4122354 C1 | 12/1992 |

(Continued)

OTHER PUBLICATIONS

Wang et al. "The Mechanism Analyzing and Use of Corner Reflector Against Anti-ship Missiles," Advances in Engineering Research , vol. 141, 5th International Conference on Mechatronics, Materials, Chemistry and Computer Engineering (ICMMCCE 2017), pp. 998-1002 (Year: 2017).*

(Continued)

*Primary Examiner* — James R Hulka
*Assistant Examiner* — Samarina Makhdoom
(74) *Attorney, Agent, or Firm* — Muncy, Geissler, Olds & Lowe, P.C.

(57) ABSTRACT

A decoy target, system, and method for protecting moving objects. The decoy target has at least two corner reflectors which reflect radar radiation, wherein the corner reflectors are arranged in a reflector matrix in a staggered manner in terms of height, width and/or depth, specified by the at least (Continued)

one connecting element, corresponding to a target to be simulated.

11 Claims, 8 Drawing Sheets

(56) References Cited

U.S. PATENT DOCUMENTS

| | | | | |
|---|---|---|---|---|
| 5,835,051 | A | 11/1998 | Bannasch et al. | |
| 6,513,438 | B1 | 2/2003 | Fegg et al. | |
| 7,886,646 | B2 | 2/2011 | Bannasch et al. | |
| 8,223,061 | B2 | 7/2012 | Bannasch et al. | |
| 8,816,894 | B1 * | 8/2014 | Apgar | H01Q 15/20 342/10 |
| 10,670,376 | B2 | 6/2020 | Grundner et al. | |
| 2004/0227657 | A1 * | 11/2004 | Atar | F42B 12/70 342/10 |
| 2007/0159379 | A1 * | 7/2007 | Bannasch | F41J 2/00 342/67 |
| 2013/0009801 | A1 * | 1/2013 | Carlsson | G01S 7/38 342/7 |
| 2014/0118178 | A1 * | 5/2014 | Yahagi | H01Q 15/18 342/8 |
| 2018/0164080 | A1 | 6/2018 | Chi-Hsueh | |

FOREIGN PATENT DOCUMENTS

| | | | |
|---|---|---|---|
| DE | 3905748 | A1 | 6/1993 |
| DE | 19617701 | A1 | 11/1997 |
| DE | 10021999 | A1 | 11/2001 |
| DE | 19951767 | C2 | 6/2002 |
| DE | 10346001 | A1 | 5/2005 |
| DE | 102005035251 | A1 | 2/2007 |
| DE | 102015002737 | A1 | 9/2016 |
| DE | 19943396 | B3 | 3/2018 |
| EP | 1371935 | A1 | 12/2003 |
| GB | 2369248 | A | 5/2002 |
| JP | 2013213726 | A | 10/2013 |
| WO | WO9004750 | A1 | 5/1990 |
| WO | WO-2019012503 | A1 * | 1/2019 |

OTHER PUBLICATIONS

International Search Report dated Sep. 8, 2020 in corresponding application PCT/EP2020/064151.

International Preliminary Report on Patentability dated Jan. 13, 2022 in corresponding application PCT/EP2020/064151.

* cited by examiner

DECOY TARGET, SYSTEM AND METHOD FOR PROTECTING AN OBJECT

This nonprovisional application is a continuation of International Application No. PCT/EP2020/064151, which was filed on May 20, 2020, and which claims priority to German Patent Application No. 10 2019 117 801.0, which was filed in Germany on Jul. 2, 2019, and which are both herein incorporated by reference.

BACKGROUND OF THE INVENTION

Field of the Invention

The present invention relates to a decoy target comprising at least two corner reflectors which reflect radar radiation. The invention also relates to a system comprising at least such a decoy target. Furthermore, the invention also relates to a method for protecting moving objects by means of a decoy target.

Description of the Background Art

Nowadays, modern, autonomously operating missiles equipped with the most modern homing systems, pose a major threat. The target subsystems of such missiles work mainly in the radar range (radio frequency range). The radar backscatter behavior of targets such as ships, aircraft, tanks, buildings is used to find and track targets.

To counter such missiles, standard decoys such as chaffs or a combination of chaffs with IR decoys (flares) are usually used as decoy targets. Such standard decoys are known, for example, from DE 10 2005 035 251 A1 (which corresponds to US 2009/0251353), DE 100 21 99 A, DE 196 17 701 A1 (which corresponds to U.S. Pat. No. 5,835,051), DE 10 2015 002 737 A1 (which corresponds to US 2018/0023928), DE 199 51 767 C2 (which corresponds to U.S. Pat. No. 6,513,438) or DE 39 05 748 A1, which are all herein incorporated by reference.

However, chaffs have about four times as high a backscattering capacity under horizontal polarization as under height polarization. Modern seeker heads of missiles can therefore recognize such decoy targets and ignore them further. This ability of modern seeker heads is also known as chaff discrimination.

In order to counteract this chaff discrimination, the firing of individual, folded corner reflectors was proposed in the past, as is known, for example, from DE103 46 001 A1 (which corresponds to US 2007/0159379) or DE 199 43 396 B3. A decoy is known from WO 90/04750 A1, which comprises several corner reflectors, which, after a cartridge is fired, are scattered by an explosive charge such that they form a decoy target on the ground. The above being incorporated herein by reference From EP 1 371 935 A1 an ammunition is known which has chaff and several deployable reflectors, which are dispersed after being ejected from an envelope of the decoy.

SUMMARY OF THE INVENTION

It is therefore an object of the present invention to provide an improved decoy target which provides effective protection against modern missiles.

According to an exemplary embodiment of the invention, a decoy target comprising at least two corner reflectors which reflect radar radiation is provided. The corner reflectors are arranged, in particular in a deployed state, in a reflector matrix in a staggered manner in terms of height, width and/or depth, corresponding to a target to be simulated.

In addition, according to the invention, a system comprising at least one decoy target of this type or as described below is provided, wherein the system has a carrier system.

Furthermore, according to the invention, a method for protecting moving objects by means of a decoy target, in particular a decoy target as described above or further developed below, is provided, wherein the method is characterized by simulating a target by arranging at least two corner reflectors in a reflector matrix in a staggered manner in terms of height, width and/or depth.

The corner reflectors are radar reflectors that include several corner reflectors. For example, these can be designed as an octahedral radar reflector with eight triangular corner reflectors. However, other configurations are also conceivable, which include a plurality of corner reflectors. Corner reflectors can reflect radiation in the millimeter wave range (radar radiation) well over a wide angular range. The surfaces of the corner reflector are made from a reflective material such as metal or a material coated with metal.

The corner reflectors formed in the decoy target according to the invention can have a different backscatter behavior so that the radar signature generated by the individual corner reflectors differs from each other in order to reproduce the target to be simulated as precisely as possible.

It is also possible to simulate the radar signature of a target accordingly precise with a reduced radar signature by using appropriate corner reflectors in a way that the seeker head of an approaching missile can be thereby deceived and/or deflected.

However, corner reflectors with the same backscatter behavior can also be used.

The reflector matrix comprises a large number of corner reflectors, which are arranged in a staggered manner in terms of height, width and/or depth corresponding to a target to be simulated. Radar signatures of one's own infrastructure, fleet or one's own vehicles are known and/or can be determined. The reflector matrix is adapted to these known radar signatures in order to simulate the own vehicle (e.g., land vehicle, ship, or aircraft) or object accordingly.

Furthermore, the reflector matrix can be adapted to the type of missile in order to simulate the target to be simulated accordingly. In particular, the radar signature of a target is simulated by the reflector matrix and the corresponding arrangement of the corner reflectors. Corner reflectors can be arranged accordingly in the reflector matrix for simulating the radar signature of a target to be simulated as precisely as possible. Furthermore, it can be provided that, if a missile that is easily deceived or deflected has been detected, only a small number of reflectors adapted to it is deployed, which is sufficient to repel the missile.

The decoy target according to the invention may be chaff-free.

To form a decoy target according to the invention, in particular, sixteen, twenty-four, thirty-two or sixty-four corner reflectors can be provided in the form of a reflector matrix. Although it is possible to create a decoy target according to the invention with at least two corner reflectors, it has been found that an increased or higher number is advantageous.

The invention ensures that the seeker head of an approaching missile can be reliably deceived. This happens because the seeker head of the missile activates the decoy as a target and the missile is deflected away from the object to be protected or is completely fixed on the decoy, since the radar signature of the decoy target is correspondingly more distinctive than the radar signature of the object to be protected. By placing the corner reflectors in a reflector matrix, the reflector properties are enhanced compared to individual corner reflectors due to this spatial arrangement. These decoy targets cannot be distinguished from the actual target by the seeker head of an attacking missile due to the reflection properties of a corner reflector. The tactical use of the decoy targets according to the invention provides that, depending on the threat, for example a small number of corner reflectors are geometrically positioned as a reflector matrix or also in other configurations.

The corner reflectors can be connected to each other via at least one connecting element to form the reflector matrix, wherein the staggered manner in terms of height, width and/or depth is specified by the at least one connecting element.

The connection by the connecting elements can be permanent or temporary.

In further development of the decoy target it can be provided that the staggered manner in terms of height, width and/or depth of the individual corner reflectors of the reflector matrix is constant over a certain period of time, in particular the end phase of a missile attack.

The end phase of a missile attack can be understood, in particular, to be the period of time in which the seeker head has activated the target or the decoy target. According to the invention, the staggered manner in terms of height, width and/or depth of the individual corner reflectors of the reflector matrix is constant for this period of time, so that the attacking missile attacks the decoy target and not the actual target. In other words, the distribution of the corner reflectors in the reflector matrix is constant. Depending on the speed and the different seeker heads of the missiles, the duration of the end phase of a missile attack can vary.

The connecting element can be correspondingly strong or thick-walled to keep the staggered manner in terms of height, width and/or depth of the individual corner reflectors of the reflector matrix constant over a certain period of time, in particular the end phase of a missile attack. For this purpose, the connecting element has a corresponding thickness or density.

Furthermore, it can be provided that the at least one connecting element can comprise at least one network, at least one wire, at least one cord, at least one line, at least one rope and/or at least one hose, etc.

In this way it can be achieved that the individual corner reflectors are temporarily, in particular for the end phase of a missile attack, or permanently connected with one another and are arranged in the desired staggered manner in terms of height, width and/or depth.

In a further development of the decoy target, it can be provided that the corner reflectors are foldable or inflatable corner reflectors.

Furthermore, the decoy target can be developed in such a way that the reflector matrix provides a linear, staggered manner in terms of height, width and/or depth for simulating a target.

Furthermore, the decoy target can be designed in such a way that the decoy target comprises at least three corner reflectors and the reflector matrix provides a level, staggered manner in terms of height, width and/or depth for simulating a target.

Furthermore, the decoy target can provide that the decoy target comprises at least four corner reflectors and the reflector matrix provides a spatial, staggered manner in terms of height, width and/or depth for simulating a target. This allows for certain decoy targets to be optimally displayed.

In a further development of the decoy target, it can be provided that the decoy target is an airborne decoy target.

The decoy target can be designed such that it can be fired, in particular from a launcher or a launcher system.

Further, the decoy target can be designed to fall freely. For this purpose, the decoy target can be connected to a parachute or a braking device, whereby the decoy target is braked in free fall and slowed down in this.

The system can be further developed in such a way that the carrier system can include at least one unmanned aircraft, at least one parachute and/or at least one braking device.

It can also be provided that the plurality of corner reflectors are connected to the aircraft, the parachute, or the braking device in a floating manner via the at least one connecting element.

In a further development, the method can provide that the staggered manner in terms of height, width and/or depth of the individual corner reflectors of the reflector matrix is kept constant over a certain period of time, in particular the end phase of a missile attack.

It may also be provided that the decoy target is airborne. Furthermore, in a it can be provided that the plurality of corner reflectors are connected to an unmanned aerial vehicle, a parachute, or a braking device in a floating manner.

The decoy target can be shootable. The firing can take place in particular from a launcher or a launcher system using mechanical, pyrotechnic, or pneumatically.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
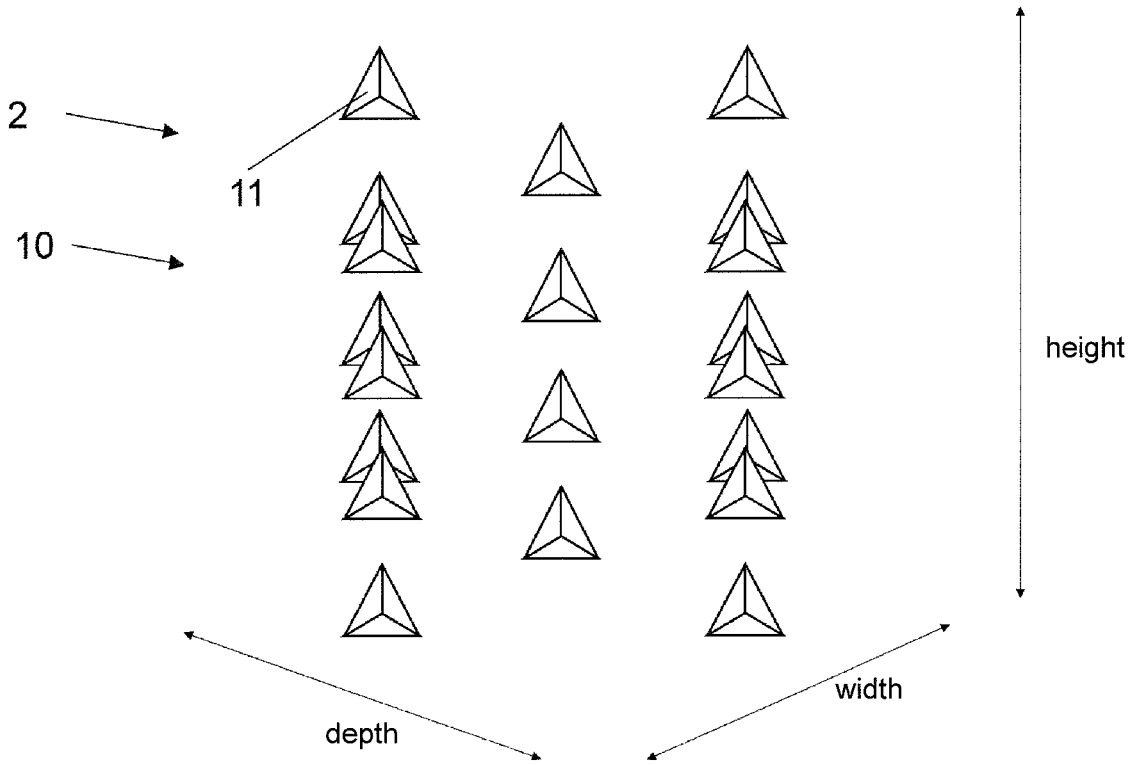
FIG. 1 is a schematic representation of a decoy target according to an exemplary embodiment of the invention.

FIG. 1 shows a schematic representation of a decoy target 2 according to the invention according to a first embodiment in a deployed state.

The decoy target 2 has at least two corner reflectors 11 which reflect radar radiation. The corner reflectors 11 of the decoy target 2 are arranged in a reflector matrix with a staggered manner in terms of height, width and/or depth, corresponding to a target to be simulated.

The corner reflectors 11 are foldable or inflatable corner reflectors 11.

According to FIG. 1, the decoy target 2 has a plurality, e.g., twenty corner reflectors 11, which form the reflector matrix 10 and provide a spatial, staggered manner in terms of height, width and/or depth for simulating a target. It is also possible that the decoy target 2 has fewer corner reflectors 11 than shown, in particular sixteen, twenty-four, thirty-two or sixty-four, wherein at least four corner reflectors 11 are used to form a spatial, staggered manner in terms of height, width and/or depth.

However, it is also possible that the decoy target 2 according to the invention provides a reflector matrix 10 in a linear, staggered manner in terms of height, width and/or depth for simulating a target. For this purpose, at least two corner reflectors 11 are necessary.

It is equally possible for the decoy target 2 to include three corner reflectors 11 and for the reflector matrix 10 to provide a planar or level, staggered manner in terms of height, width and/or depth for simulating a target. For this purpose, at least three corner reflectors 11 are formed.

The decoy target 2 according to FIG. 1 is designed to be shootable so that it can be fired, for example, from a launcher or a launcher system.

The decoy target 2 according to FIG. 1 is designed to fall freely.

FIGS. 2*a* to 7 each show examples of the decoy target 2 according to the invention, in which the decoy target 2 has at least one connecting element 13 by which the corner reflectors 11 are connected to one another to form the reflector matrix 10.

The examples according to FIGS. 2*a* to 7 are based on FIG. 1 and the differences are additionally explained below.

The decoy targets 2 are part of a system 1 which, in addition to at least one decoy target 2, has at least one carrier system 20, 20', 30, 40. The at least one carrier system 20, 20', 30, 40 is each designed to carry or brake the decoy target 2 in the air, so that the decoy targets 2 according to FIGS. 2*a* to 7 are airborne decoy targets 2. Carrier system(s) 20, 20', 30, 40 and decoy target 2 together form the system 1 according to the invention.

The at least one connecting element 13 is designed in such a way that the staggered manner in terms of height, width and/or depth of the individual corner reflectors 11 of the reflector matrix 10 is constant over a certain period of time, in particular the end phase of a missile attack.

According to the embodiments shown, the at least one connecting element 13 has at least one wire, at least one cord, at least one line, at least one rope and/or at least one hose.

The connecting element 13 can, however, also be formed as a network.

Figure 2A:
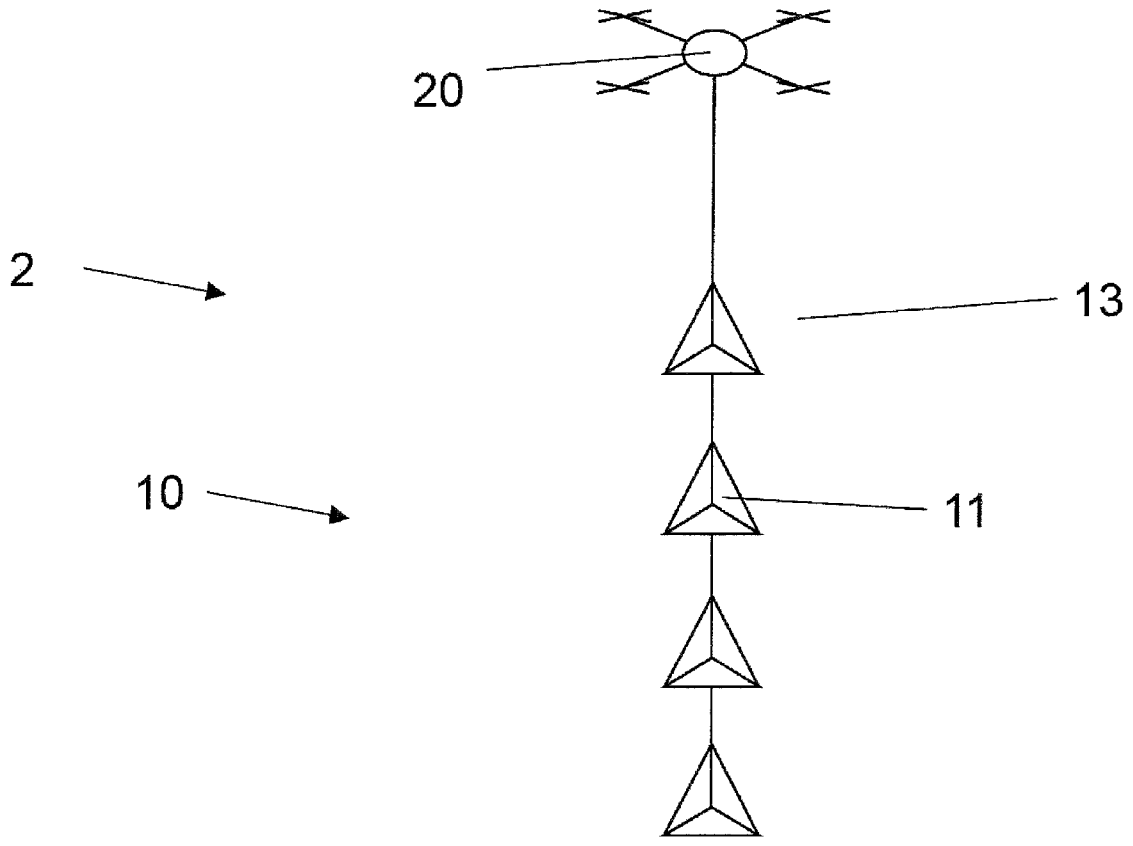
FIG. 2*a* is a schematic representation of a decoy target according to an exemplary embodiment of the invention.

FIG. 2*a* shows a schematic representation of a decoy target 2 according to the invention in the deployed state. According to FIG. 2*a*, the decoy target 2 has a reflector matrix 10 with a linear, staggered manner in terms of height for simulating a target. According to FIG. 2*a*, the carrier system is at least an unmanned aerial vehicle 20 and the decoy target 2 is connected to it.

According to FIG. 2*a*, the majority of corner reflectors 11 are connected to the aircraft 20 in a floating manner via the at least one connecting element 13. According to FIG. 2*a*, aircraft 20 is a drone with a plurality of propellers.

Figure 2B:
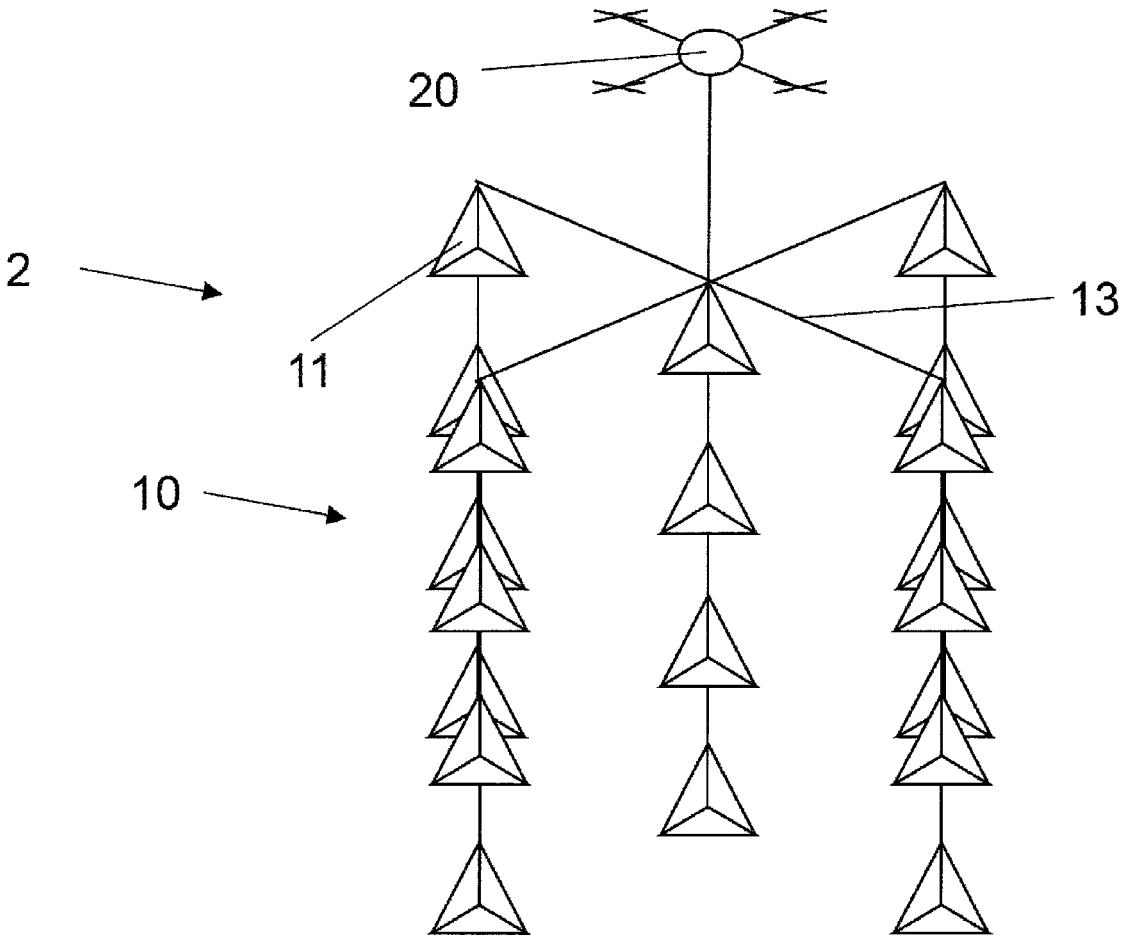
FIG. 2*b* is a schematic representation of a decoy target according to an exemplary embodiment of the invention.

FIG. 2*b* shows a decoy target 2 according to the invention in the deployed state, based on FIG. 2*a*. Departing from FIG. 2*a*, the decoy target 2 has a spatial, staggered manner in terms of height for simulating a target.

Figure 3:
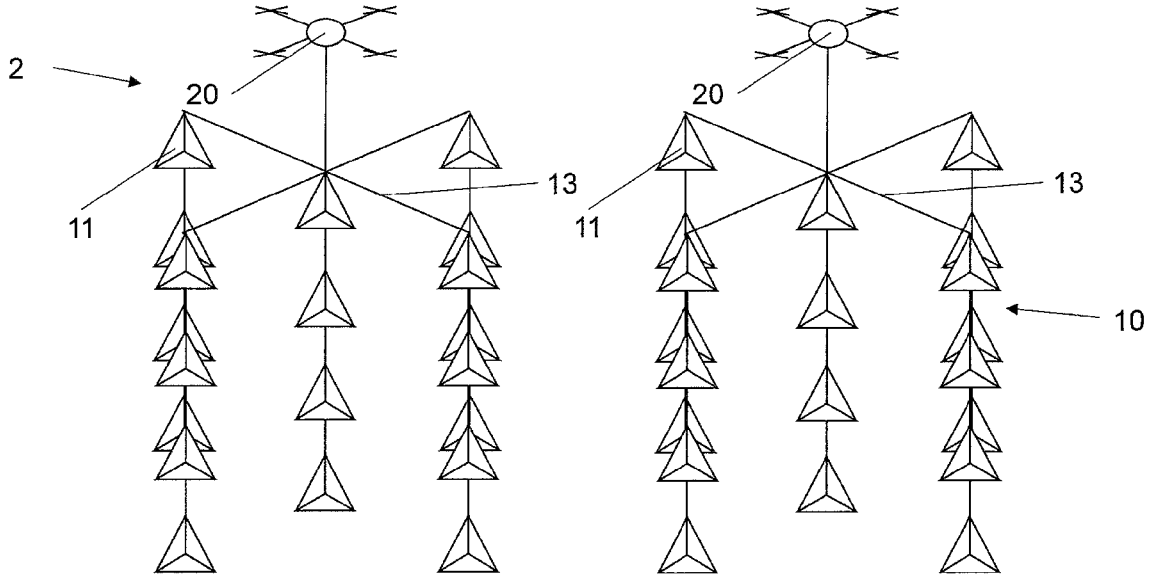
FIG. 3 is a schematic representation of a decoy target according to an exemplary embodiment of the invention.

FIG. 3 shows a schematic representation of a decoy target 2 according to the invention in the deployed state. The decoy target 2 has at least four corner reflectors 11, so that the reflector matrix 10 has a spatial, staggered manner in terms of height, width and/or depth.

Each of the two decoy targets 3 is carried by an aircraft 20, in particular a drone.

Figure 4:
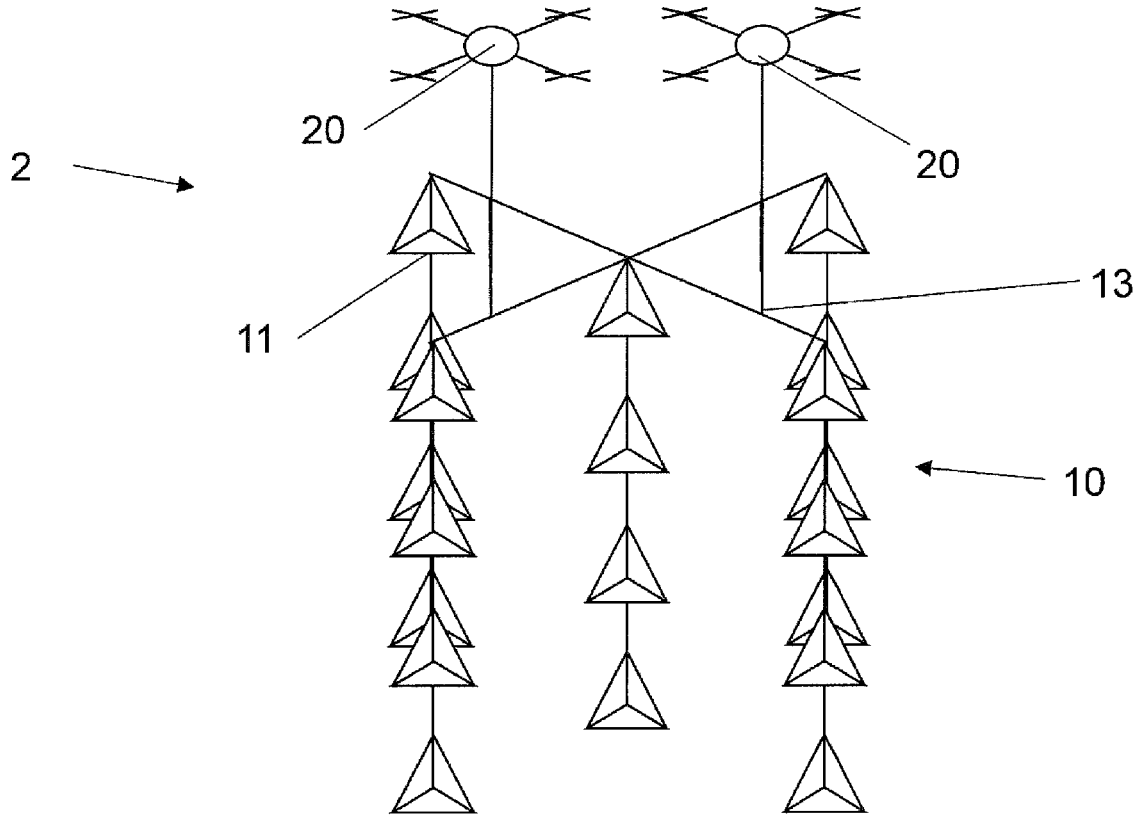
FIG. 4 is a schematic representation of a decoy target according to an exemplary embodiment of the invention.

FIG. 4 shows a schematic representation of a decoy target 2 according to the invention in the deployed state. The example according to FIG. 4 is based on the example according to FIG. 2*a*, with the difference that several aircraft 20, preferably two aircraft 20, in particular two drones 20 jointly carry the decoy target 2.

Figure 5:
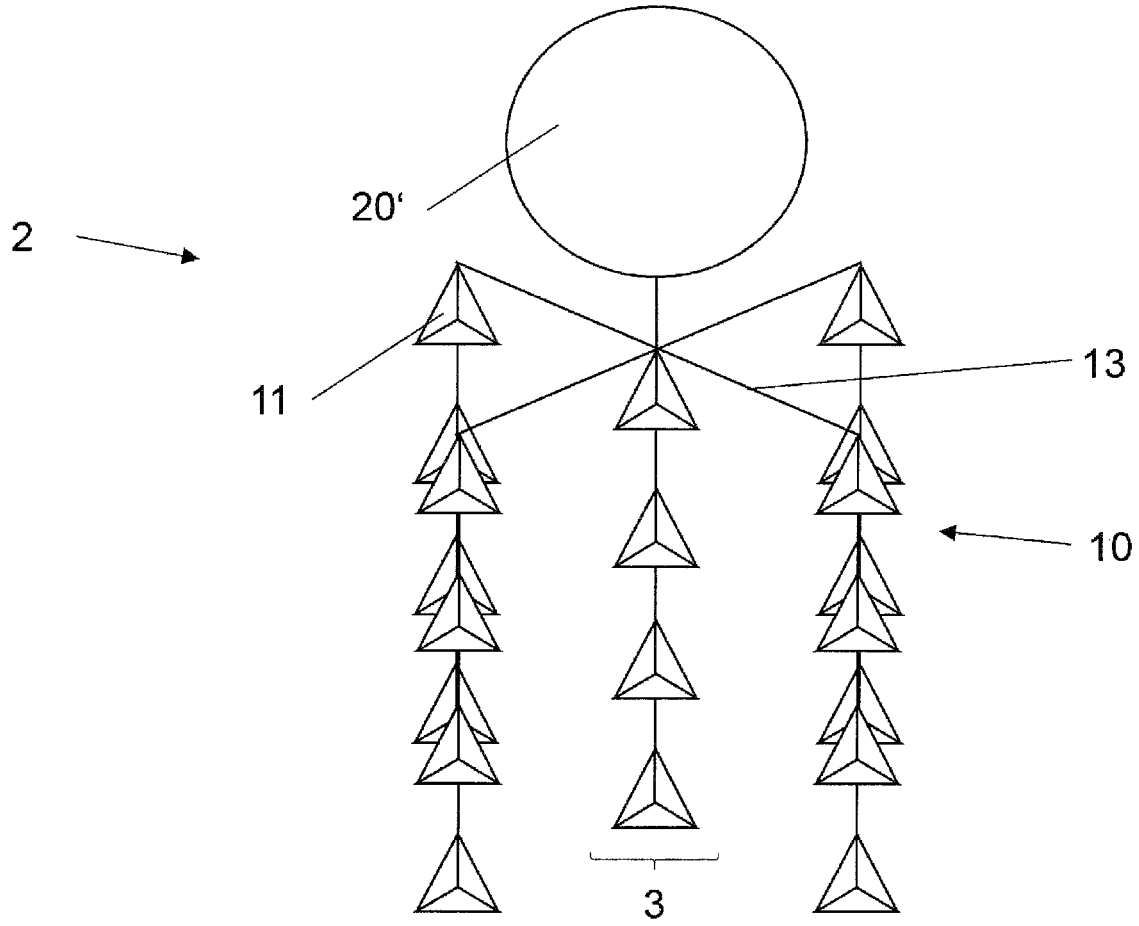
FIG. 5 is a schematic representation of a decoy target according to an exemplary embodiment of the invention.

FIG. 5 shows a schematic representation of a decoy target 2 according to the invention in the deployed state. The example according to FIG. 5 is based on the example according to FIG. 2*a*, with the difference that according to FIG. 5, the decoy target 2 is carried by an aircraft 20' in the form of a balloon.

Figure 6:
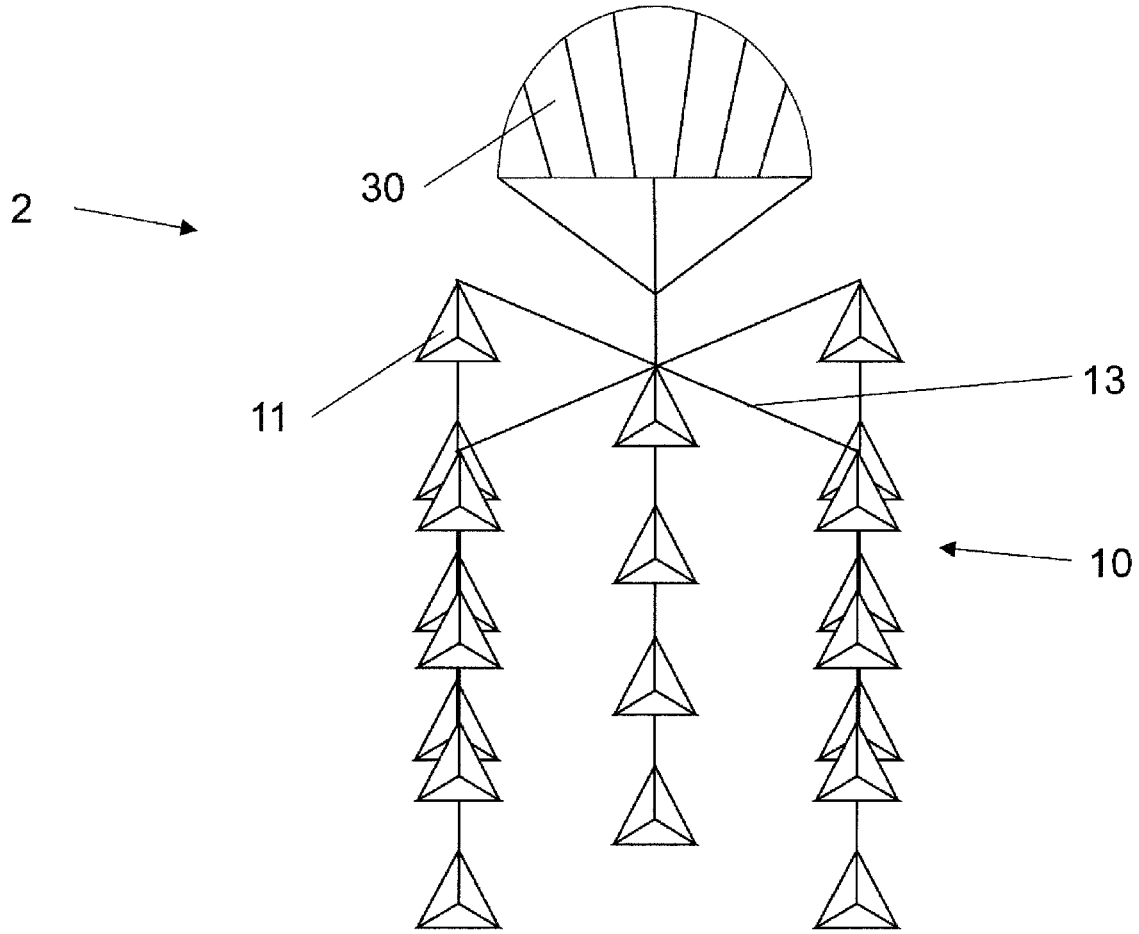
FIG. 6 is a schematic representation of a decoy target according to an exemplary embodiment of the invention.

FIG. 6 shows a schematic representation of a decoy target 2 according to the invention in the deployed state. The embodiment according to FIG. 6 is based on the embodiment according to FIG. 2*a*, with the difference that according to FIG. 6, instead of an aircraft, a parachute 30 is designed as a carrier system with which the plurality of corner reflectors 11 are connected to the parachute 30 via the at least one connecting element 13 in a suspended manner. The parachute 30 slows down the fall of the system in order to achieve a sufficient dwell time of the decoy target 2 to be able to repel an end-phase guided missile.

Figure 7:
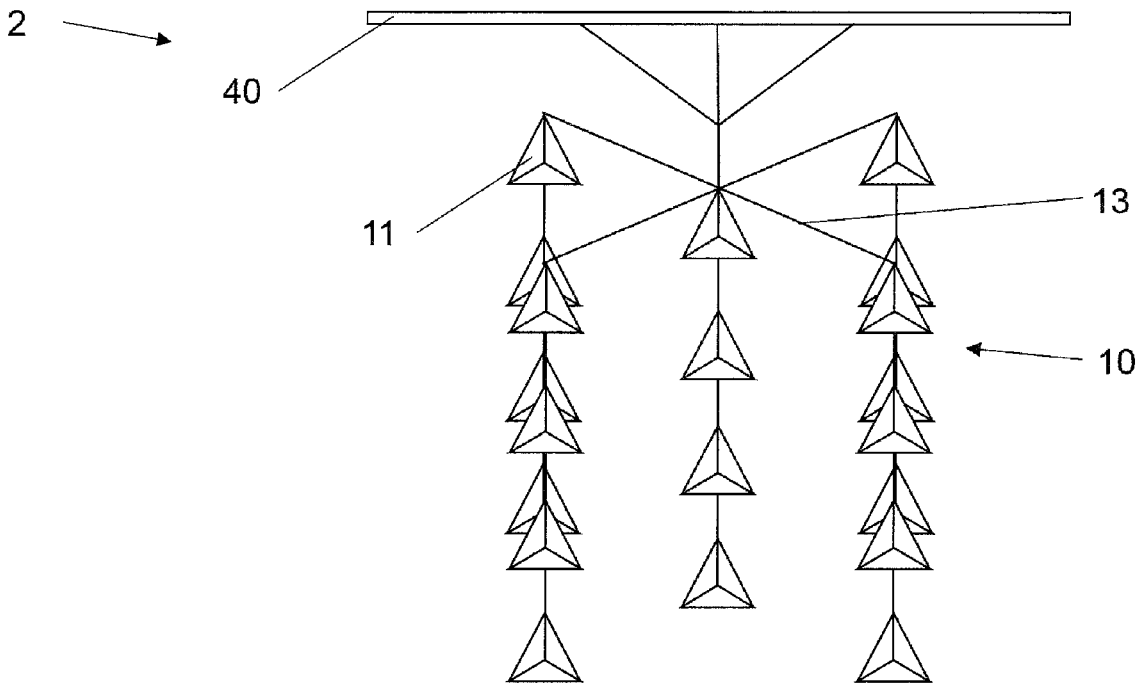
FIG. 7 is a schematic representation of a decoy target according to an exemplary embodiment of the invention.

FIG. 7 shows a schematic representation of a decoy target 2 according to the invention in the deployed state. The example according to FIG. 7 is based on the example according to FIG. 2*a*, with the difference that according to FIG. 6 a braking device 40 is provided instead of the parachute 30.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A system comprising:

at least two decoy targets, each of the at least two decoy targets having at least two corner reflectors that are arranged in a reflector matrix in a spatial, staggered manner in terms of height, width and/or depth for simulating a target; and a carrier system, the carrier system comprising at least two unmanned aircraft, at least two parachutes or at least two braking devices, wherein the at least two corner reflectors of a first decoy target of the at least two decoy targets being connected to a first one of the at least two unmanned aircraft, the at least two parachutes or the at least two braking devices via at least one first connecting element that extends vertically from a bottom of the first one of the at least two unmanned aircraft, the at least two parachutes or the at least two braking devices, with a first upper end of the at least one first connecting element being connected to the bottom of the first one of the at least two unmanned aircraft, the at least two parachutes or the at least two braking devices and a second lower end of the at least one first connecting element being connected to the reflector matrix of the first decoy target, such that the reflector matrix of the first decoy target hangs below the first one of the at least two unmanned aircraft, the at least two parachutes or the at least two braking devices in a floating manner, wherein the at least two corner reflectors of a second decoy target of the at least two decoy targets being connected to a second one of the at least two unmanned aircraft, the at least two parachutes or the at least two braking devices via at least one second connecting element that extends vertically from a bottom of the second one of the at least two unmanned aircraft, the at least two parachutes or the at least two braking devices, with a first upper end of the at least one second connecting element being connected to the bottom of the second one of the at least two unmanned aircraft, the at least two parachutes or the at least two braking devices and a second lower end of the at least one second connecting element being connected to the reflector matrix of the second decoy target, such that the reflector matrix of the second decoy target hangs below the second one of the at least two unmanned aircraft, the at least two parachutes or the at least two braking devices in a floating manner, wherein the at least one first connecting element is discrete from the at least one second connecting element, such that the at least two corner reflectors of the first decoy target are connected solely to the first one of the at least two unmanned aircraft, the at least two parachutes or the at least two braking devices, and such that the at least two corner reflectors of the second decoy target are connected solely to the second one of the at least two unmanned aircraft, the at least two parachutes or the at least two braking devices, and wherein the first one and the second one of the at least two unmanned aircrafts, the at least two parachutes or the at least two braking devices are arranged adjacent to one another when airborne and operate independently from one another, such that the reflector matrix of the first decoy target and the reflector matrix of the second decoy target together form a spatial arrangement for simulating the target without any interconnection between the first decoy target and the second decoy target.

2. The system according to claim 1, wherein the spatial, staggered manner in terms of height, width and/or depth of the reflector matrix of the first decoy target is specified by the at least one first connecting element and the spatial, staggered manner in terms of height, width and/or depth of the reflector matrix of the second decoy target is specified by the at least one second connecting element.

3. The system according to claim 1, wherein the spatial, staggered manner in terms of height, width and/or depth of the reflector matrix of the first decoy target and the reflector matrix of the second decoy target is constant over a certain period of time or at an end phase of a missile attack.

4. The system according to claim 2, wherein the at least one first connecting element and the at least one second connecting element are designed such that the spatial, staggered manner in terms of height, width and/or depth of the reflector matrix of the first decoy target and the reflector matrix of the second decoy target is constant over a certain period of time or at an end phase of a missile attack.

5. The system according to claim 1, wherein the at least one first connecting element and the at least one second connecting element each comprise at least one network, at least one wire, at least one cord, at least one line, at least one rope and/or at least one hose.

6. The system according to claim 1, wherein the at least two corner reflectors of each of the first decoy target and the second decoy target are foldable or inflatable corner reflectors.

7. The system according to claim 1, wherein each of the first decoy target and the second decoy target comprise at least four corner reflectors.

8. The system according to claim 1, wherein each of the first decoy target and the second decoy target are shootable from a launcher or a launcher system.

9. The system according to claim 1, wherein each of the first decoy target and the second decoy target are free-falling.

10. A method for protecting moving objects using the system of claim 1, the method comprising:

providing the at least two corner reflectors of the first decoy target and the at least two corner reflectors of the second decoy target; and simulating the target by arranging the first one and the second one of the at least two unmanned aircrafts, the at least two parachutes or the at least two braking devices adjacent to one another upon firing, such that the reflector matrix of the first decoy target and the reflector matrix of the second decoy target together form the spatial arrangement.

11. The method according to claim 10, wherein the spatial, staggered manner in terms of height, width and/or depth of the reflector matrix of the first decoy target and the reflector matrix of the second decoy target is kept constant over a certain period of time or at an end phase of a missile attack.

* * * * *